US009580886B2

(12) United States Patent
Nakagaki et al.

(10) Patent No.: US 9,580,886 B2
(45) Date of Patent: Feb. 28, 2017

(54) WORKING VEHICLE

(71) Applicant: YANMAR CO., LTD., Osaka-shi, Osaka (JP)

(72) Inventors: Mitsuhiro Nakagaki, Osaka (JP); Katsuya Miyazaki, Osaka (JP); Katashi Tanaka, Osaka (JP); Mitsuhiro Takahashi, Chikugo (JP)

(73) Assignee: YANMAR CO., LTD., Osaka-Shi, Osaka (JP)

( * ) Notice: Subject to any disclaimer, the term of this patent is extended or adjusted under 35 U.S.C. 154(b) by 0 days.

(21) Appl. No.: 14/765,112

(22) PCT Filed: Jan. 23, 2014

(86) PCT No.: PCT/JP2014/051390

§ 371 (c)(1),
(2) Date: Jul. 31, 2015

(87) PCT Pub. No.: WO2014/119464

PCT Pub. Date: Aug. 7, 2014

(65) Prior Publication Data

US 2015/0368876 A1 Dec. 24, 2015

(30) Foreign Application Priority Data

Jan. 31, 2013 (JP) ..... 2013-017347

(51) Int. Cl.
*E02F 9/20* (2006.01)
*E02F 3/43* (2006.01)
*E02F 9/26* (2006.01)

(52) U.S. Cl.
CPC ..... *E02F 9/2033* (2013.01); *E02F 3/435* (2013.01); *E02F 9/265* (2013.01)

(58) Field of Classification Search
None
See application file for complete search history.

(56) References Cited

U.S. PATENT DOCUMENTS 5,957,989 A 9/1999 Egawa et al.
5,995,001 A * 11/1999 Wellman ..... B66F 17/003 340/438

(Continued)

FOREIGN PATENT DOCUMENTS

EP 0786559 A2 7/1997
JP S63122829 A 5/1988

(Continued)

OTHER PUBLICATIONS

International Search Report corresponding to Application No. PCT/JP2014/051390; Date of Mailing: Apr. 28, 2014, with English translation.

(Continued)

*Primary Examiner* — Thomas Tarcza
*Assistant Examiner* — Garrett Evans
(74) *Attorney, Agent, or Firm* — Cantor Colburn LLP

(57) ABSTRACT

A working vehicle is configured so that interference does not occur even if an attachment is exchanged and so that a reduction in work efficiency caused by the exchange of an attachment is minimized. A backhoe comprises: a working machine body; a working device which is connected to the working machine body, has joints, and allows an attachment to be removably mounted to the front end of the working device; and a control device in which stop positions are set, the stop positions being those at which the working device is stopped in order to avoid the interference of the working device. The control device has connected thereto: a position sensor which detects the position of the working device; an input means by which the stop positions are set in advance and by which the stop positions are adjusted independently of each other; and a screen operation section which allows selection among the stop positions.

8 Claims, 9 Drawing Sheets

(56) References Cited

U.S. PATENT DOCUMENTS

| | | | | |
|---|---|---|---|---|
| 6,169,948 | B1 | 1/2001 | Fujishima et al. | |
| 2012/0089305 | A1* | 4/2012 | Behncke ..... | B66F 17/003 701/50 |

FOREIGN PATENT DOCUMENTS

| | | | |
|---|---|---|---|
| JP | H09256405 | A | 9/1997 |
| JP | H108490 | A | 1/1998 |
| JP | H10280485 | A | 10/1998 |
| JP | 2006028908 | A | 2/2006 |
| JP | 2010105569 | A | 5/2010 |
| WO | 2006008851 | A1 | 1/2006 |

OTHER PUBLICATIONS

Extended European Search Report corresponding to Application No. 14746810.2-1712/2952635, PCT/JP2014/051390; Dated: Aug. 19, 2016.

Japanese Notice of Reasons for Refusal corresponding to Application No. 2013-017347; Shipping Date: Aug. 2, 2016, with English translation.

Korean Notification of Reasons for Refusal corresponding to Application No. 10-2015-7023465; Date of Mailing Dec. 1, 2016, with English Translation.

* cited by examiner

WORKING VEHICLE

CROSS REFERENCE TO RELATED APPLICATIONS

This is the U.S. national stage of application No. PCT/JP2014/051390, filed on Jan. 23, 2014. Priority under 35 U.S.C. §119(a) and 35 U.S.C. §365(b) is claimed from Japanese Application No. 2013-017347, filed Jan. 31, 2013, the disclosure of which is also incorporated herein by reference.

TECHNICAL FIELD

The present invention relates to a working vehicle. In more detail, the present invention relates to an art of restricting a movable range of a working device.

BACKGROUND ART

Conventionally, a working vehicle such as a backhoe is configured so that an operation lever device is operated so as to make a working device provided in the working vehicle perform predetermined action and work. With respect to various operations of the operation lever device of the working vehicle, various attachments such as a bucket attached to a tip of the working device may interfere a revolving device or an object within a movable range. Accordingly, the working vehicle is known in which the movable range of the working device can be restricted to an optional range with respect to the various operations of the operation lever device. For example, see the Patent Literature 1.

For example, as shown in the Patent Literature 1, when the bucket is exchanged with a breaker, an arm is moved actually to a raking side so as to realize a state in which the breaker is quite close to a boom cylinder. When a memorizing command is ordered at this state, henceforth, the arm raking movement is stopped at a state separated from the quite close state to an arm extension side for a set angle, and the arm is not moved to a boom side.

However, concerning the working vehicle with the above configuration, complicated work is required for treating various attachments, whereby working efficiency may be reduced.

PRIOR ART REFERENCE

Patent Literature

Patent Literature 1: the Japanese Patent Laid Open Gazette Hei. 10-8490

DISCLOSURE OF INVENTION

Problems to be Solved by the Invention

The present invention is provided for solving the problems, and the purpose of the present invention is to provide a working device which can avoid interference even if a plurality of attachments are exchanged and relive reduction of working efficiency following exchange of the attachments.

Means for Solving the Problems

The problems to be solved by the present invention have been described above, and subsequently, the means of solving the problems will be described below.

According to the present invention, a working vehicle includes a working machine body, a working machine which is connected to the working machine body and has a plurality of joints and whose tip is connected detachably to an attachment, and a control device in which a stop position is set so as to stop the working device for avoiding interference of the working device. The control device is connected to a detection means which detects a position of the working device, an input means which sets previously a plurality of stop positions and adjusts independently the plurality of the stop positions, and a selection means which selects the plurality of the stop positions.

According to the present invention, concerning each of the plurality of the stop positions, an adjustment range which does not include the other stop positions is determined.

According to the present invention, the input means adjusts the stop positions by inputting numerical values.

According to the present invention, the input means adjusts the stop positions by direct teaching which makes the working device move to the stop positions and memorizes the positions.

According to the present invention, at least a part of the input means is detachably attached to the control device.

According to the present invention, the detection means detects an angle of the joint of the working device.

Effect of the Invention

The present invention configured as the above brings the following effects.

According to the present invention, the plurality of the stop positions can be adjusted independently, and the adjusted stop position does not affect the other stop positions. Accordingly, when the attachment is exchanged, readjustment is not required and the interference can be avoided, whereby reduction of working efficiency can be relieved.

According to the present invention, the value of the adjustment range of each of the stop positions does not includes the stop positions except for the stop position to be adjusted so that the relation among the values of the stop positions in the selection means is not reversed, whereby confusion at the time of selecting the values of the plurality of the stop positions is prevented.

According to the present invention, the stop positions can be adjusted without moving the working device, whereby the adjustment work can be performed easily.

According to the present invention, at the time of adjusting the stop positions, the stop positions can be checked visually, whereby the adjustment work can be performed easily. Furthermore, when the adjustment of the stop positions with the direct teaching gets out of the adjustment range, the stop positions are not adjusted so that the relation between the values of the stop positions in the selection means is not reversed, whereby confusion at the time of selecting the values of the plurality of the stop positions is prevented.

According to the present invention, since at least the part of the input means is detachably attached to the control device, the stop positions cannot be adjusted carelessly, whereby the working device can be operated safely.

According to the present invention, by only detecting the angle of the working device, the stop positions can be judged, whereby the control configuration can be made simple.

DETAILED DESCRIPTION OF THE INVENTION

Figure 1:
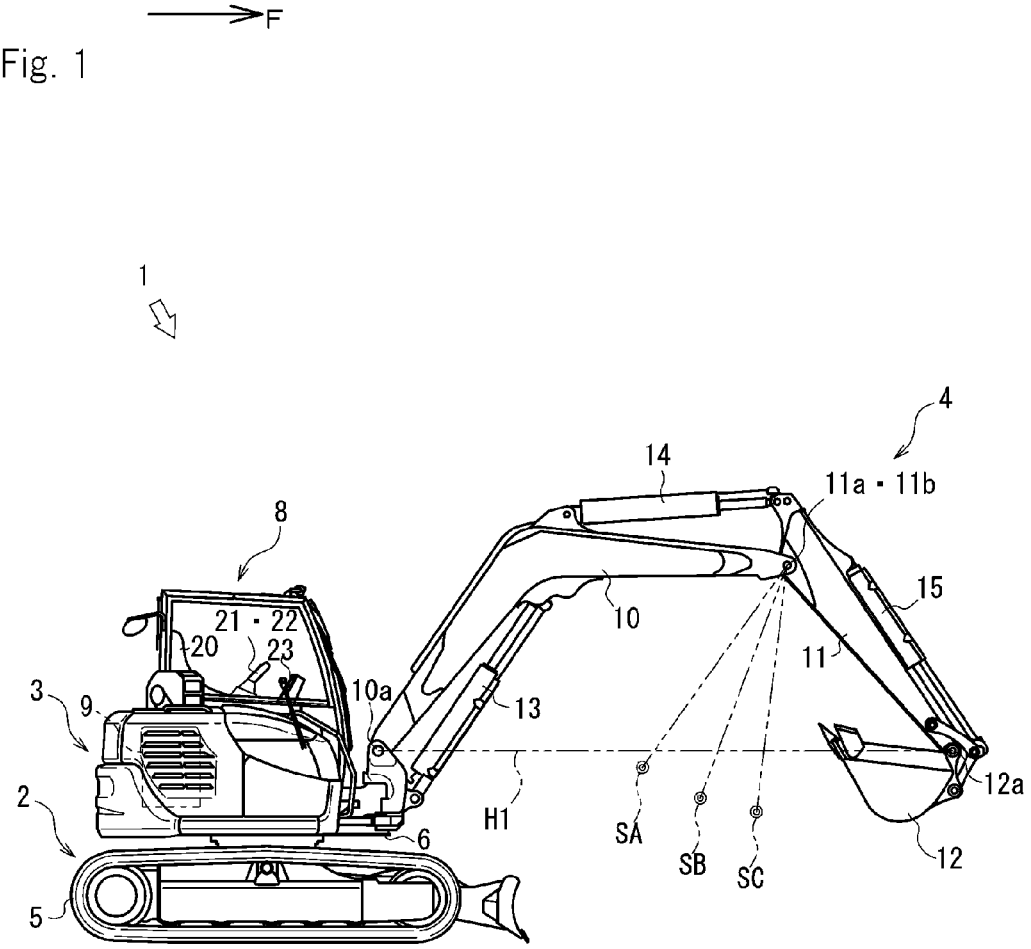
FIG. 1 is a side view of an entire configuration of a working vehicle according to an embodiment of the present invention.
Figure 2:
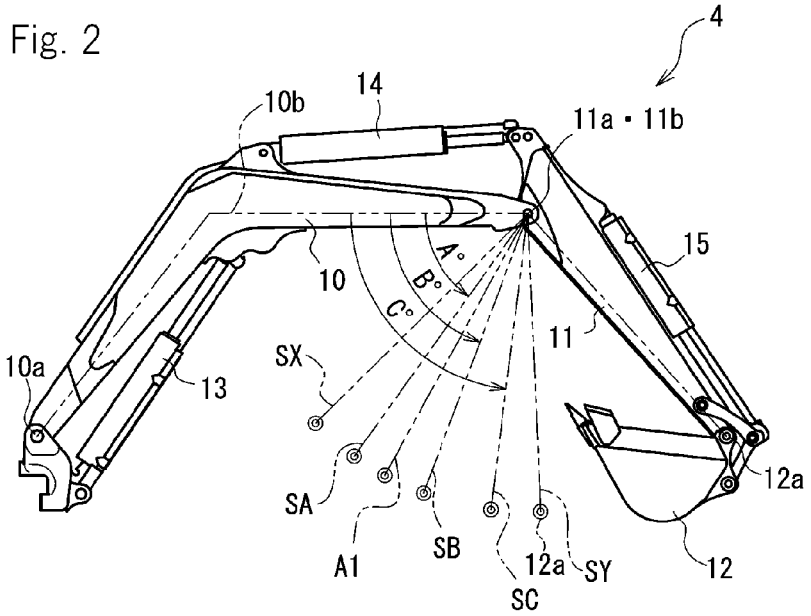
FIG. 2 is a side view of stop positions of a working device.
Figure 3:
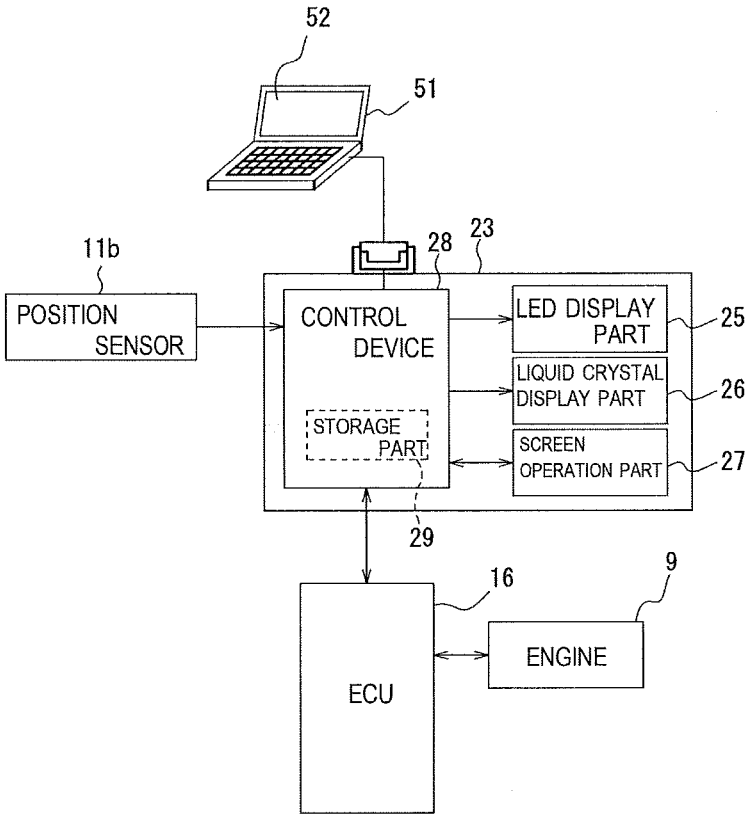
FIG. 3 is a block diagram of stop control.

Firstly, a backhoe 1 which is a working vehicle according to an embodiment of the present invention is described referring to FIGS. 1 to 3. Though this embodiment is explained while the backhoe 1 is regarded as the embodiment of the working vehicle, the working vehicle is not limited thereto and may alternatively be another agricultural vehicle, construction vehicle, industrial vehicle or the like. For make the explanation easy, a direction of an arrow F is regarded as a front direction of the backhoe 1, and longitudinal and lateral directions at the time of riding on the backhoe 1 and looking at the forward are regarded as longitudinal and lateral directions of the backhoe 1.

The backhoe 1 mainly has a traveling device 2, a revolving device 3 and a working device 4.

The traveling device 2 mainly has a pair of left and right crawlers 5. By driving the crawlers 5 at left and right sides of a vehicle body, the traveling device 2 can make the backhoe 1 travel longitudinally and turn.

The revolving device 3 is a working machine body and mainly has a revolving base 6, an operation part 8 and an engine 9. The revolving base 6 is a main structure of the revolving device 3. The revolving base 6 is arranged above the traveling device 2 and supported rotatably by the traveling device 2. In the revolving device 3, by driving a revolving motor (not shown), the revolving base 6 can be revolved with respect to the traveling device 2. On the revolving base 6, the operation part 8 having various operation instruments and the engine 9 which is a power source are arranged.

The working device 4 mainly has a boom 10, an arm 11, a bucket 12 which is a kind of an attachment, a boom cylinder 13, an arm cylinder 14, and an attachment cylinder 15.

One of ends of the boom 10 is supported rotatably on a front part of the revolving base 6 by a boom fulcrum 10*a* which is a joint. The boom 10 is rotated around the boom fulcrum 10*a* by the boom cylinder 13 which is driven telescopically. In more detail, when the boom cylinder 13 is extended, the boom 10 is rotated upward, and when the boom cylinder 13 is contracted, the boom 10 is rotated downward.

One of ends of the arm 11 is supported rotatably on the other end of the boom 10 by an arm fulcrum 11*a* which is a joint. The arm 11 is rotated around the arm fulcrum 11*a* at the one of ends by the arm cylinder 14 which is driven telescopically. In more detail, when the arm cylinder 14 is extended, the arm 11 is rotated downward (so as to make the other end of the arm 11 close to the boom 10), and when the arm cylinder 14 is contracted, the arm 11 is rotated upward (so as to separate the other end of the arm 11 from the boom 10). In a support part of the arm 11, a position sensor 11*b* detecting a rotation position of the arm 11 is provided. Though a detection means is the position sensor 11*b* and detects the rotation position of the arm 11 in this embodiment, the detection means is not limited thereto and may alternatively detect an amount of extension and contraction of the arm cylinder 14. Though the position sensor 11*b* which is the detection means is provided only in the arm fulcrum 11*a*, the arrangement is not limited thereto and position sensors (angle detection sensors) may alternatively be arranged in the boom fulcrum 10*a* and an attachment fulcrum 12*a* so as to grasp a more detailed position of the attachment.

One of ends of the bucket 12 which is the kind of the attachment is supported rotatably on the other end of the arm 11 by the attachment fulcrum 12*a* which is a joint. The bucket 12 is rotated around the attachment fulcrum 12*a* at the one of ends by the attachment cylinder 15 which is driven telescopically. In more detail, when the attachment cylinder 15 is extended, the bucket 12 is rotated downward (so as to make the other end of the bucket 12 close to the arm 11), and when the attachment cylinder 15 is contracted, the bucket 12 is rotated upward (so as to separate the other end of the bucket 12 from the arm 11).

As the above, in the working device 4, an articulated structure which digs soil with the bucket 12 is configured. Though the working device 4 which has the bucket 12 and performs digging work is provided in the backhoe 1 according to this embodiment, the working device is not limited thereto and a working device which has a hydraulic breaker and performs crush work may alternatively be provided.

In the operation part 8, an operation seat 20 is provided at a substantially center, and a right operation lever device 21 and a left operation lever device 22 are arranged at right and left sides of the operation seat 20. With the operation lever devices, the revolving motor, the boom cylinder 13, the arm cylinder 14 and the attachment cylinder 15 can be operated. A display device 23 is provided at one of the lateral sides (in this embodiment, the right side) of the operation seat 20. The display device 23 is arranged so as to make a display part thereof opposite to an operator sitting on the operation seat 20.

Next, stop positions SA, SB and SC which are set for avoiding interference of the working device 4 is explained.

The stop positions SA, SB and SC of this embodiment are defined by angles between an upper arm part 10*b* of the boom 10 and the arm 11 in the state in which the boom fulcrum 10*a* and the attachment fulcrum 12*a* are connected with a horizontal line H1 as shown in FIGS. 1 and 2. Namely, at the stop positions SA, SB and SC, when the arm 11 moving toward a raking side reaches stop angles A, B and C with respect to the boom 10, the movement of the arm 11 is stopped. With respect to the stop angles, in the state shown in FIG. 2, a counterclockwise direction is regarded as a positive direction and a clockwise direction is regarded as a negative direction. The plurality of the stop angles A, B and C are set so as to correspond to various attachments. In this embodiment, the stop angles corresponding to the stop positions SA, SB and SC are set so that one of the stop positions SA, SB and SC can be selected suitably, whereby the interference of the working device 4 is prevented.

In an order closer to the revolving device 3, the stop positions SA, SB and SC are referred to as the first stop position SA at the raking side, the second stop position SB at a central side, and the third stop position SC at an extending side. The first stop angle A is a set value corresponding to the first stop position SA, the second stop angle B is a set value corresponding to the second stop position SB, and the third stop angle C is a set value corresponding to the third stop position SC. A minimum stop angle X corresponding to a position SX at which the arm 11 is the most close to the boom 10 and a maximum stop angle Y corresponding to a position SY at which the arm 11 is separated maximally from the boom 10 are set previously.

The stop positions SA, SB and SC can be adjusted respectively independently. An adjustment range of each of the stop positions SA, SB and SC does not include the values of the other of the stop positions SA, SB and SC. Namely, a range whose setting can be adjusted is set previously with respect to each of the stop positions SA, SB and SC, and the adjustable range of a new first stop angle A1 at the first stop position SA is $X \leq A1 < X1$. The adjustable range of a new second stop angle B1 at the second stop position SB is $X1 \leq B1 \leq X2$. The adjustable range of a new third stop angle C1 at the third stop position SC is $X2 < C1 \leq Y$. The stop angles used for the adjustable range has a relation $X < X1 < X2 < Y$.

Next, a configuration of stop control is explained referring to a block diagram of the configuration of stop control shown in FIG. 3 and drawings of an adjustment selection screen 53 and an adjustment screen 57 displayed in a display part 52 shown in FIG. 4.

A control device 28 controls a LED display part 25 and a liquid crystal display part 26 by operating a screen operation part 27. The control device 28 is configured in a frame body 24 (see FIG. 6) close to the LED display part 25 and the liquid crystal display part 26 or integrally with an ECU 16.

The ECU 16 controls the engine 9, a hydraulic pump (not shown) and the like. Various programs are stored in the ECU 16 so as to control the engine 9, the hydraulic pump and the like. The ECU 16 can perform predetermined calculations according to the programs and store results of the calculations and the like. Substantially, the ECU 16 may be configured by connecting a CPU, a ROM, a RAM, a HDD and the like with a bus, or may alternatively be a one-chip LSI or the like.

The ECU 16 is connected to various sensors and a fuel injection device (not shown) provided in the engine 9 and can control the engine 9. The ECU 16 is connected to the control device 28 of the display device 23, and can transmit signals concerning warning, error information, fuel residual quantity, cooling water temperature and the like to the control device 28 and obtain input signals inputted to the control device 28.

The control device 28 is connected to the position sensor 11*b* which is the detection means, an input means 51 in which the stop angles A, B and C corresponding to the plurality of (three) the stop positions SA, SB and SC are set previously and which the stop angles A, B and C are adjusted independently, and the screen operation part 27 which is a selection means selecting the plurality of the stop positions SA, SB and SC.

The input means 51 is a personal computer or the like provided separately from the display device 23 and detachably attached to the control device 28 in the display device 23. By operating the input means 51, the stop positions SA, SB and SC can be adjusted. Though the input means 51 is provided separately in this embodiment, the input means is not limited thereto and may alternatively be inserted into the display device 23 and adjust the stop positions SA, SB and SC.

Figure 4A:
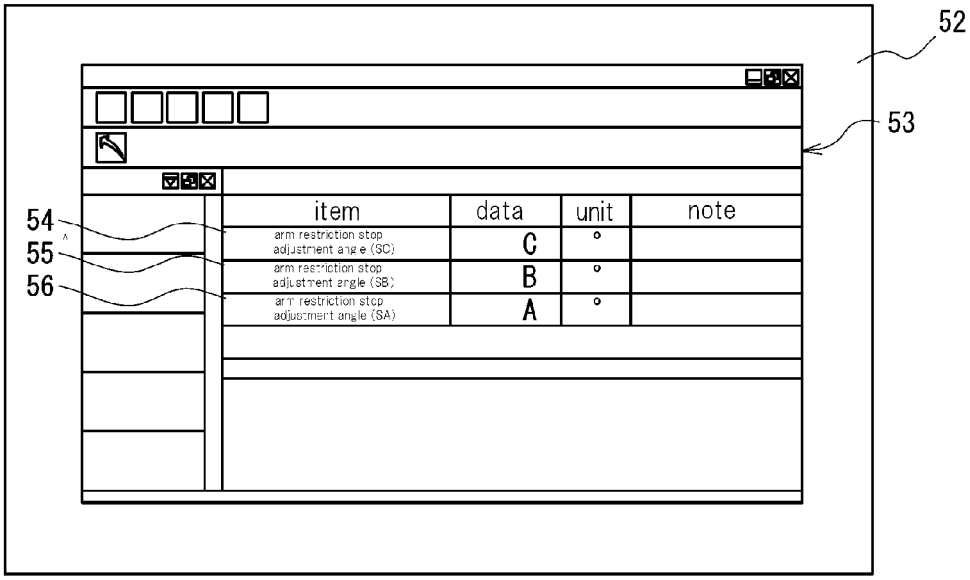
FIG. 4A is a drawing of an adjustment selection screen displayed in a display part.

At the time of adjusting the stop positions SA, SB and SC, the adjustment selection screen 53 shown in FIG. 4A is displayed in the display part 52 of the input means 51. In the display screen, an item 54 of an arm restriction adjustment angle (SC), an item 55 of an arm restriction adjustment angle (SB), an item 56 of an arm restriction adjustment angle (SA) are displayed.

Figure 4B:
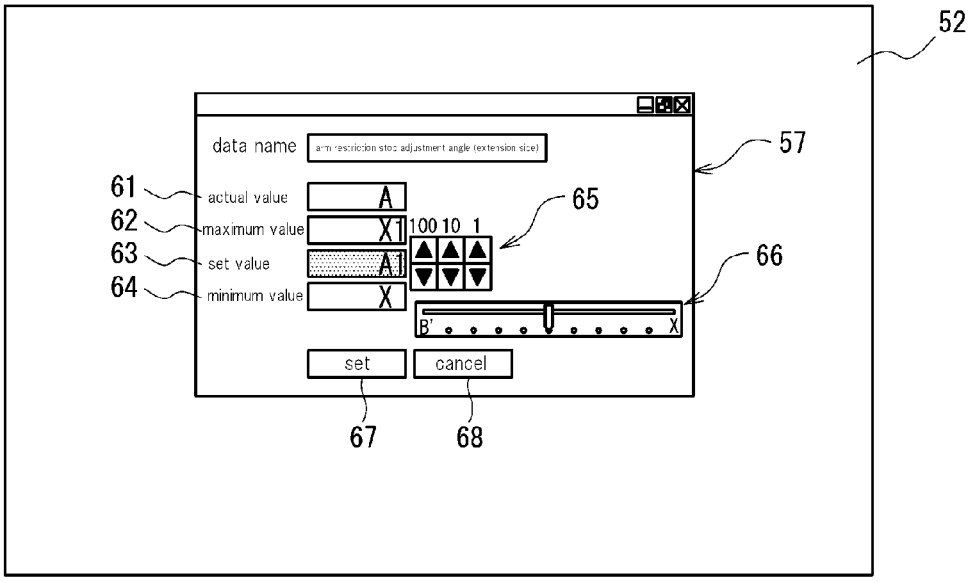
FIG. 4B is a drawing of an adjustment screen displayed in the display part.

An operator selects the item to be adjusted from the items 54, 55 and 56 so that the adjustment screen 57 is displayed in the display part 52. The adjustment screen 57 shown in FIG. 4B is displayed when the item 56 of the arm restriction adjustment angle (SA) is selected, and the first stop angle A of the first stop position SA is adjusted via the adjustment screen 57. In the adjustment screen 57, an actual value before adjustment (the first stop angle A) is displayed in an item 61, an adjustable maximum value X1 (strictly, less than X1) is displayed in an item 62, a new set value (the first stop angle A1 to be adjusted) is displayed in an item 63, and an adjustable minimum value X is displayed in an item 64. A unit of the values displayed in the items 61, 62, 63 and 64 is an angle.

At the right of the item 63 of the new set value, an adjustment button group 65 is provided. With the adjustment button group 65, the new first stop angle A1 displayed in the item 63 of the new set value can be adjusted. In the adjustment button group 65, hundredth order, tenth order and first order are provided, and a button for increasing the value and a button for reducing the value are provided in each of the orders. Below the adjustment button group 65, a slide bar 66 is provided, and by sliding the slide bar 66, the new first stop angle A1 of the item 63 of the new set value can be adjusted. In a lower part of the adjustment screen 57, a set button 67 for storing the adjusted new first stop angle A1 of the item 63 of the new set value and a cancel button 68 for stopping the adjustment on the way are provided.

Figure 5:
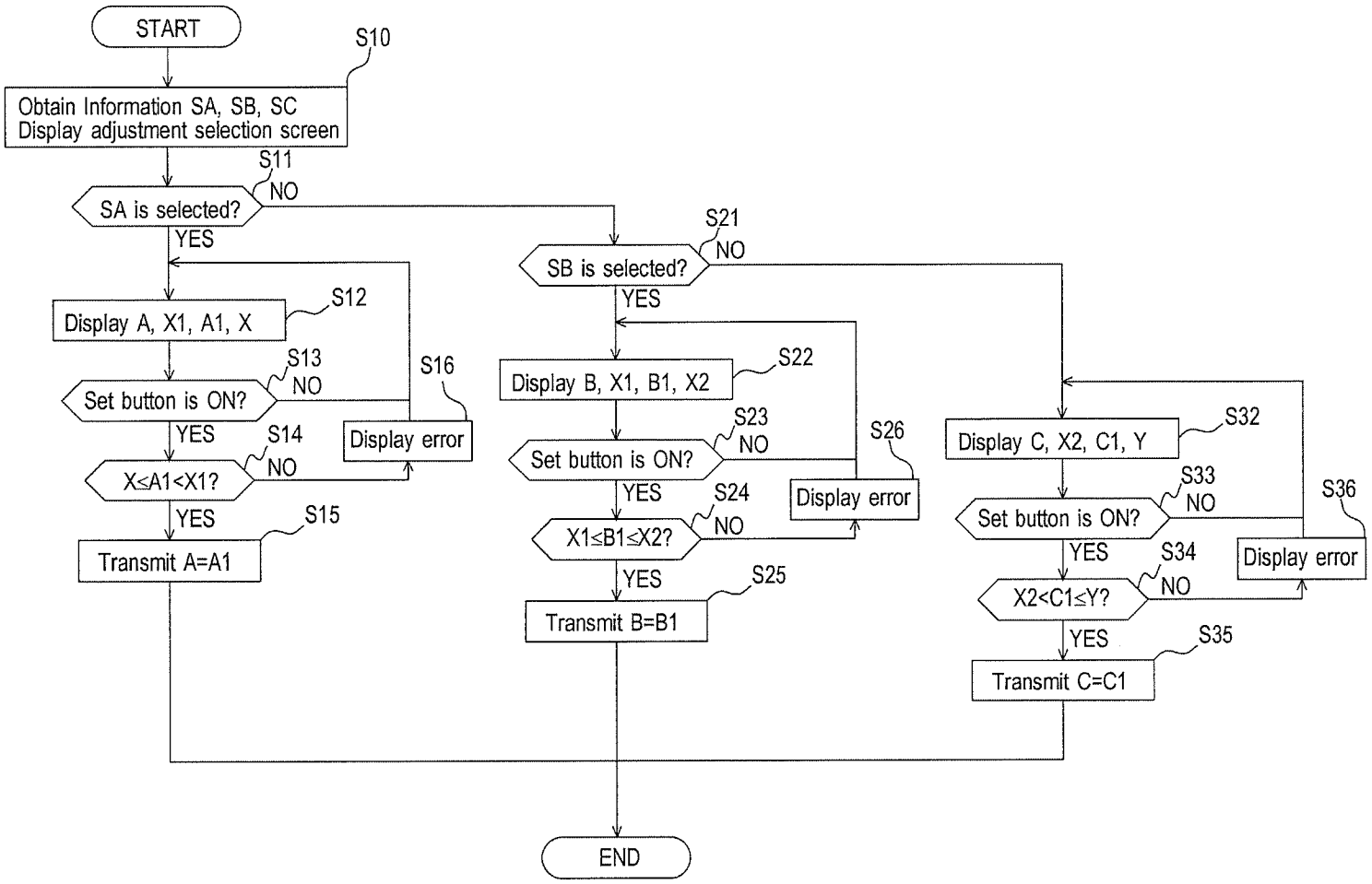
FIG. 5 is a flow chart of adjustment of the stop positions in an input means.

Next, control steps of the input means 51 adjusting the stop angles A, B and C of the stop positions SA, SB and SC are explained referring to FIGS. 3 to 5.

Firstly, as shown in FIG. 3, the input means 51 is connected to the control device 28 at the side of the backhoe 1 and started so as to enable the adjustment of the stop angles A, B and C corresponding to the stop positions SA, SB and SC.

Namely, at a step S10 of a flow chart of the adjustment of the stop positions SA, SB and SC in the input means 51 shown in FIG. 5, the input means 51 obtains information of the stop positions SA, SB and SC which has been set actually from the control device 28 of the backhoe 1, and displays the adjustment selection screen 53 (see FIG. 4). When an operator selects one of the three items 54, 55 and 56 of the stop positions displayed in the adjustment selection screen 53, the control is shifted from the step S10 to a step S11.

At the step S11, the input means 51 judges whether the first stop positions SA (item 56) is selected or not.

As a result, when the first stop position SA is judged to be selected, the input means 51 shifts from the step S11 to a step S12.

On the other hand, when the first stop position SA is judged not to be selected, that is, when the second stop position SB or the third stop position SC is judged to be selected, the input means 51 shifts from the step S11 to a step S21.

At the step S12, the input means 51 displays the adjustment screen 57 shown in FIG. 4B. At this time, the input means 51 displays the adjustable maximum value B and the adjustable minimum value X of the first stop position SA, the first stop angle A which is the actual set value, and the set value A1 to be adjusted in the adjustment screen 57. Then, by operating the adjustment button group 65 or the slide bar 66, a user adjusts the first stop angle A to the new first stop angle A1.

At a step S13, the input means 51 judges whether the user pushes the set button 67 after adjusting the new first stop angle A1 of the first stop position SA or not.

As a result, when the set button 67 is judged to be pushed, the input means 51 shifts from the step S13 to a step S14.

On the other hand, when the set button 67 is judged not to be pushed, the input means 51 shifts from the step S13 to the step S12 again.

At the step S14, the input means 51 judges whether the adjusted first stop angle A1 is within the adjustable range or not. Namely, the input means 51 judges whether "the stop angle X at which the arm 11 is the most close to the revolving device 3≤the adjusted first stop angle A1<the stop angle X1 set previously" or not.

As a result, when the adjusted first stop angle A1 is judged to be within the adjustable range, the input means 51 shifts from the step S14 to a step S15.

On the other hand, when the adjusted first stop angle A1 is judged to be out of the adjustable range, the input means 51 shifts from the step S14 to a step S16. At the step S16, it is displayed that the adjusted first stop angle A1 cannot be adjusted (changed) (the error is displayed), and then the input means 51 shifts from the step S16 to the step S12.

At the step S15, the input means 51 transmits the adjusted first stop angle A1 as the new first stop angle A to a storage part 29 of the control device 28 of the backhoe 1 and finishes the control.

The transferred new first stop angle A1 is updated in the storage part 29 of the control device 28 by finishing and restarting the backhoe 1.

At the step S11, when the first stop position SA is judged not to be selected, that is, when the second stop position SB or the third stop position SC is judged to be selected, the input means 51 shifts to the step S21 and judges whether the second stop position SB (item 55) is selected or not.

As a result, when the second stop position SB is judged to be selected, the input means 51 shifts from the step S21 to a step S22.

On the other hand, when the second stop position SB is judged not to be selected, that is, when the third stop position SC is judged to be selected, the input means 51 shifts from the step S21 to a step S32.

At the step S22, the input means 51 displays the adjustment screen 57 for the second stop position SB.

At this time, the input means 51 displays the second stop angle B which is the actual set value in the item 61 of the adjustment screen 57, the adjustable maximum value X2 of the second stop position SB in the item 62, the set value to be adjusted (the second stop angle B1) in the item 63, and the adjustable minimum value X1 of the second stop position SB in the item 64. Then, by operating the adjustment button group 65 or the slide bar 66, the user adjusts the second stop angle B to the new second stop angle B1 (see the drawing of the first stop position SA shown in FIG. 4B).

At a step S23, the input means 51 judges whether the user pushes the set button 67 after adjusting the new second stop angle B1 of the second stop position SB or not.

As a result, when the set button 67 is judged to be pushed, the input means 51 shifts from the step S23 to a step S24.

On the other hand, when the set button 67 is judged not to be pushed, the input means 51 shifts from the step S23 to the step S22 again.

At the step S24, the input means 51 judges whether the adjusted second stop angle B1 is within the adjustable range or not. Namely, the input means 51 judges whether "the stop angle X1 set previously≤the adjusted second stop angle B1≤the stop angle X2 set previously" or not. At this time, the adjusted second stop angle B1 is not less than the stop angle X1 set previously and not more than the stop angle X2 set previously so that the relation among the values of the stop positions SA, SB and SC is not reversed, whereby confusion caused by reversing the magnitude at the time of selecting the plurality of the values of the stop positions is prevented.

As a result, when the adjusted second stop angle B1 is judged to be within the adjustable range, the input means 51 shifts from the step S24 to a step S25.

On the other hand, when the adjusted second stop angle B1 is judged to be out of the adjustable range, the input means 51 shifts from the step S24 to a step S26. At the step S26, it is displayed that the adjusted second stop angle B1 cannot be adjusted (changed) (the error is displayed), and then the input means 51 shifts from the step S26 to the step S22 again.

At the step S25, the input means 51 transmits the adjusted second stop angle B1 as the new second stop angle B to the storage part 29 of the control device 28 of the backhoe 1 and finishes the control.

On the other hand, when the control is shifted from the step S21 to the step S32, the input means 51 displays the adjustment screen 57 for the third stop position SC.

At this time, the input means 51 displays the third stop angle C which is the actual set value in the item 61 of the adjustment screen 57, the adjustable maximum value Y of the third stop position SC in the item 62, the set value to be adjusted (the third stop angle C1) in the item 63, and the adjustable minimum value X2 of the third stop position SC in the item 64. Then, by operating the adjustment button group 65 or the slide bar 66, the user adjusts the third stop angle C to the new third stop angle C1 (see the drawing of the first stop position SA shown in FIG. 4B).

At a step S33, the input means 51 judges whether the user pushes the set button 67 after adjusting the new third stop angle C1 of the third stop position SC or not.

As a result, when the set button 67 is judged to be pushed, the input means 51 shifts from the step S33 to a step S34.

On the other hand, when the set button 67 is judged not to be pushed, the input means 51 shifts from the step S33 to the step S32 again.

At the step S34, the input means 51 judges whether the adjusted third stop angle C1 is within the adjustable range or not. Namely, the input means 51 judges whether "the stop angle X2 set previously≤the adjusted third stop angle C1≤the stop angle Y at which the arm 11 is the most separated from the boom 10" or not. At this time, the adjusted third stop angle C1 is not less than the stop angle X2 set previously so that the relation between the values of the stop positions SB and SC is not reversed, whereby confusion caused by reversing the magnitude at the time of selecting the plurality of the values of the stop positions is prevented.

As a result, when the adjusted third stop angle C1 is judged to be within the adjustable range, the input means 51 shifts from the step S34 to a step S35.

On the other hand, when the adjusted third stop angle C1 is judged to be out of the adjustable range, the input means 51 shifts from the step S34 to a step S36. At the step S36, it is displayed that the adjusted third stop angle C1 cannot be adjusted (changed) (the error is displayed), and then the input means 51 shifts from the step S36 to the step S32 again.

At the step S35, the input means 51 transmits the adjusted third stop angle C1 as the new third stop angle C to the storage part 29 of the control device 28 of the backhoe 1 and finishes the control.

An application method of the adjusted stop positions SA, SB and SC at the side of the backhoe 1 is explained.

Firstly, a configuration of the display device 23 which is an operation instrument for applying the stop positions SA, SB and SC is explained concretely.

Figure 6:
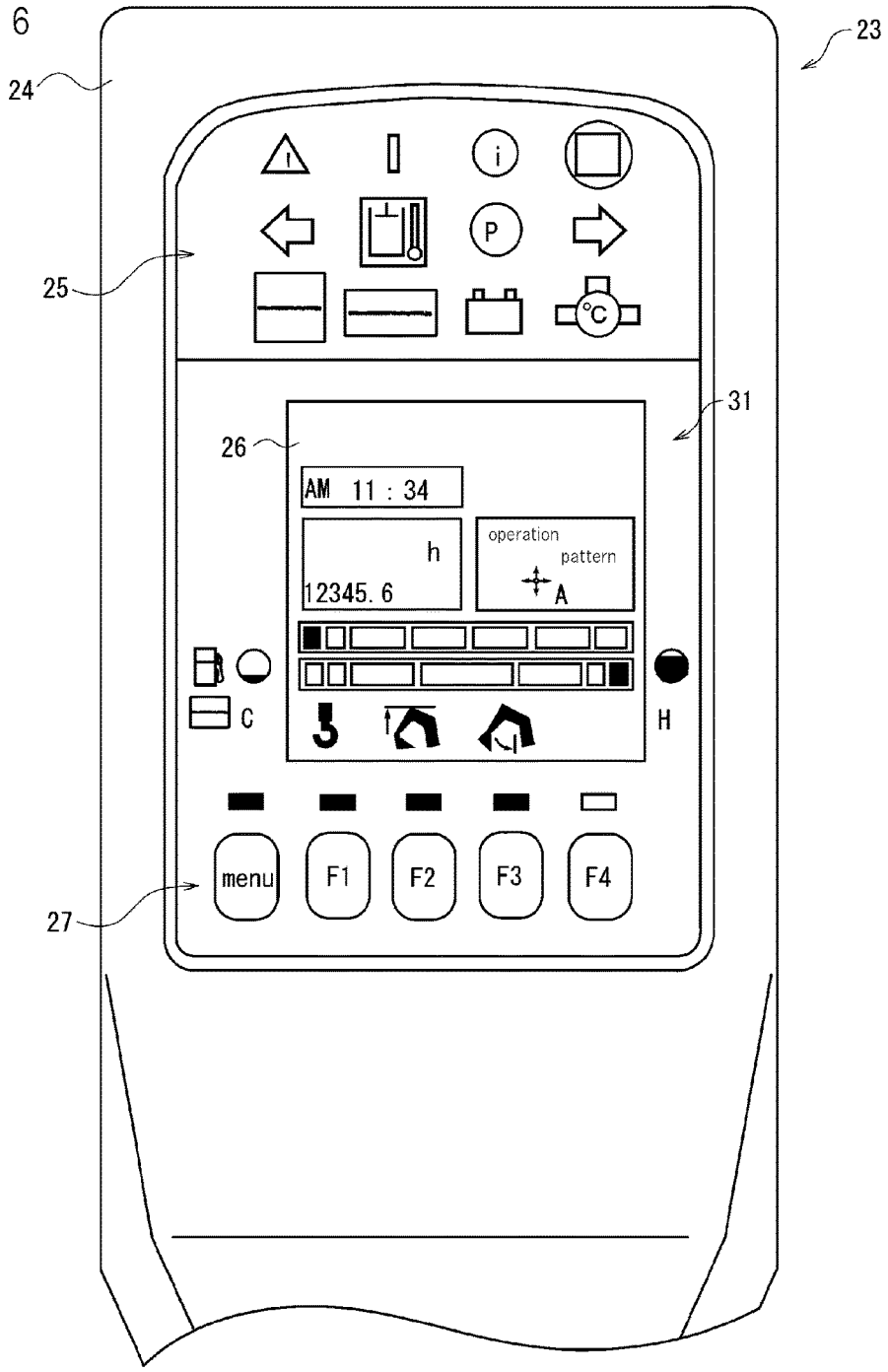
FIG. 6 is a front view of the display part of the working vehicle.

As shown in FIGS. 3 and 6, the display device 23 has the frame body 24, the LED display part 25, the liquid crystal display part 26, the screen operation part 27, and the control device 28.

The frame body 24 has an L-like box shape when viewed in side including a longer side and a shorter side. The frame body 24 is arranged at the right of the operation seat 20 so as to make a side surface of the shorter side opposite to the operation seat 20 (see FIG. 1).

The LED display part 25 is provided above the side surface of the shorter side of the frame body 24. In the LED display part 25, a plurality of figures showing an operation state of the backhoe 1 and existence of warning are displayed, and an LED is arranged in each of the figures. In the LED display part 25, only the certain figure is lightened up at a predetermined condition by lighting of the corresponding LED. Accordingly, the LED display part 25 can transmit information to an operator. Though the LED display part 25 performs the display by lighting up the LED in this embodiment, the display is not limited thereto and any light source whose lighting can be controlled may alternatively be used.

The liquid crystal display part 26 is provided in the side surface of the shorter side of the frame body 24 below the LED display part 25. The liquid crystal display part 26 includes a liquid crystal screen displaying information. In the liquid crystal display part 26, by operating the screen operation part 27 discussed below, the liquid crystal screen is switched to a screen suitable for each of work mode so as to check the operation state of the backhoe 1. Accordingly, the liquid crystal display part 26 can transmit information to an operator. Though the liquid crystal display part 26 is displayed by the liquid crystal screen in this embodiment, the display is not limited thereto and any member which can display a plurality of information may alternatively be used.

The screen operation part 27 is arranged in the side surface of the shorter side of the frame body 24 below the liquid crystal display part 26. The screen operation part 27 has a menu button and a F1 button, a F2 button, a F3 button and a F4 button which are a plurality of operation button. In the screen operation part 27, by operating the menu button, the F1 button, the F2 button, the F3 button and the F4 button, the information displayed in the liquid crystal display part 26 can be selected.

The control device 28 controls the LED display part 25 and the liquid crystal display part 26. The control device 28 is arranged inside the frame body 24 close to the LED display part 25 and the liquid crystal display part 26 or configured integrally with the ECU 16.

Next, a control mode of applying the stop positions SA, SB and SC in the control device 28 of the display device 23 configured as the above is explained concretely.

Figure 7:
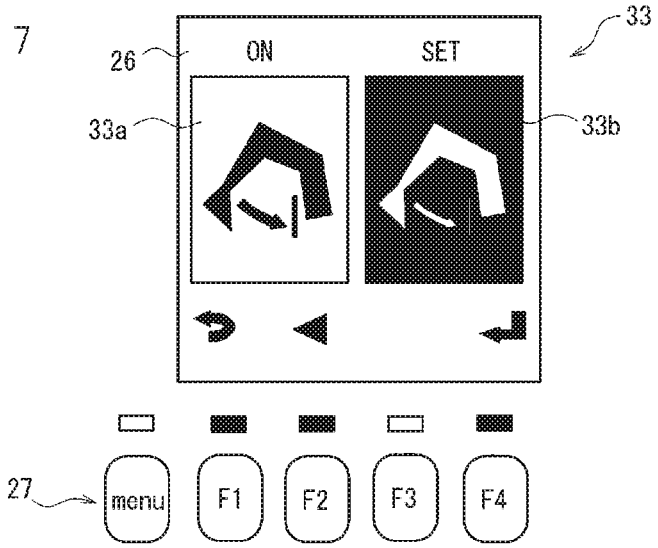
FIG. 7 is a drawing of a movable range limitation screen displayed in a display device.

In an excavation mode screen 31 shown in FIG. 6, by selecting the menu button (item) of the screen operation part 27 and performing suitable selection, a movable range limitation screen 33 shown in FIG. 7 is displayed.

Figure 8:
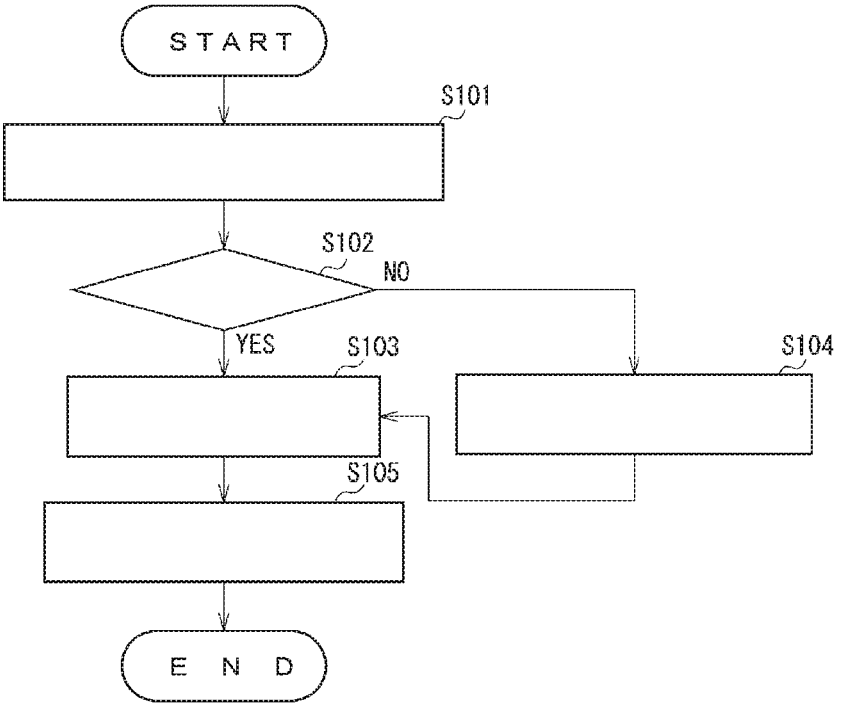
FIG. 8 is a flow chart of selection of the stop positions in a control device.

Namely, in a control flow shown in FIG. 8, the control device 28 shifts to a step S101 and displays the movable range limitation screen 33, and obtains the stop position chosen last time (one of SA, SB and SC) and the newest stop angles A, B and C corresponding to the stop positions SA, SB and SC from the storage part 29 and obtains an arm angle which is an actual angle of the arm 11 from the position sensor 11*b*. When the stop position chosen last time does not exist, a default stop position is obtained. In the movable range limitation screen 33, an operator (setting person) selects "ON" 33*a* or "SET" 33*b* and operates the F4 button which is a determination button (see FIG. 7). Then, the control device 28 shifts from the step S101 to a step S102.

At the step S102, the control device 28 judges whether "ON" 33*a* is selected or not.

As a result, when "ON" 33*a* is judged to be selected, the control device 28 shifts from the step S102 to a step S103.

On the other hand, when "ON" 33*a* is judged not to be selected, that is, when "SET" 33*b* is selected, the control device 28 shifts from the step S102 to a step S104.

Figure 9:
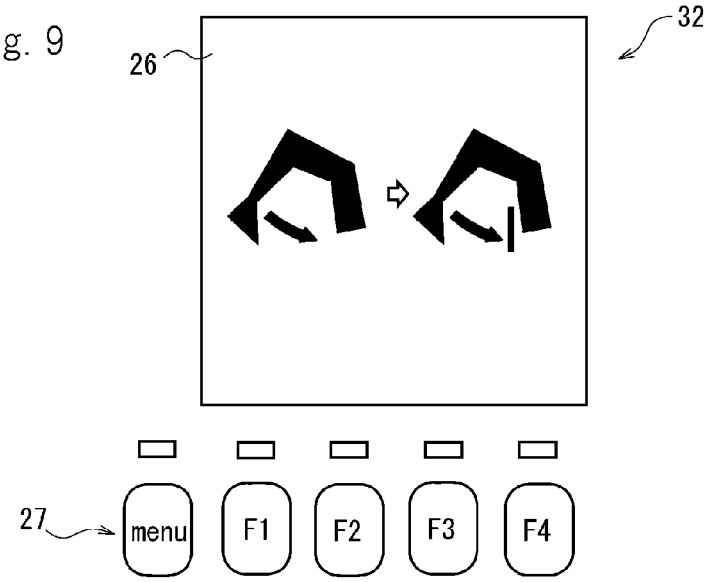
FIG. 9 is a drawing of a restriction position mode transition screen displayed in the display device.

At the step S103, the control device 28 displays a restriction position mode transition screen 32 shown in FIG. 9 for a predetermined time, and shifts from the step S103 to a step S105.

Figure 10:
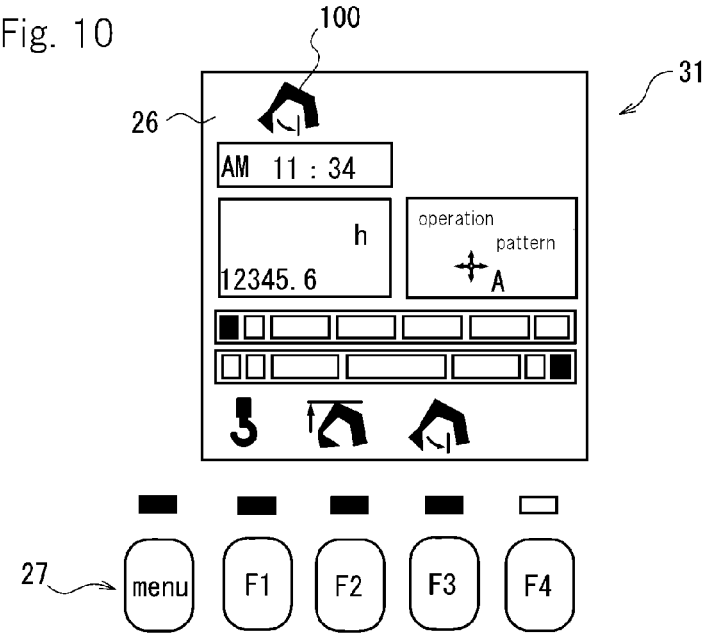
FIG. 10 is a drawing of an excavation mode screen displayed in the display device.

At the step S105, the control device 28 displays the excavation mode screen 31 in which a stop position control ON mark 100 shown in FIG. 10 is lighted up, finishes the control of selection of the stop positions SA, SB and SC, and executes control for avoiding interference of the working device 4.

Figure 11:
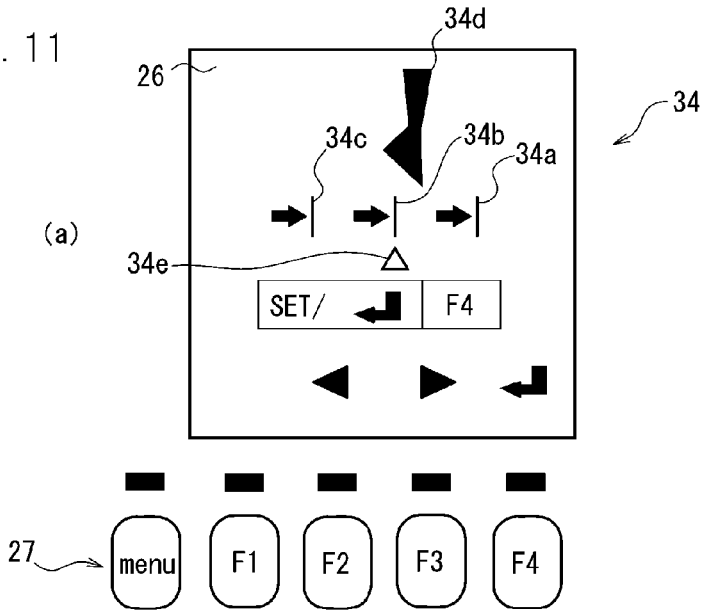
FIG. 11 is a drawing of a restriction position SET mode screen displayed in the display device.

On the other hand, at the step S104, the control device 28 displays a restriction position SET mode screen 34 shown in FIG. 11. In the restriction position SET mode screen 34, an actual position 34*d* of the arm obtained at the step S102 and the stop position set last time are displayed. The operator moves a void triangle mark 34*e* with F2 and F3 of the screen operation part 27 and selects suitable stop position marks 34*a*, 34*b* and 34*c*. When the operator operates F4 so as to decide the selected one of the stop position marks 34*a*, 34*b* and 34*c*, the control device 28 shifts from the step S104 to the step S103.

The first stop position mark 34*a*, the second stop position mark 34*b* and the third stop position mark 34*c* shown in FIG. 11 correspond respectively to the first stop position SA, the second stop position SB and the third stop position SC Actually, the input means 51 may alternatively be configured so that the working device 4 is moved to the desired stop position, the position (angle) is memorized and the stop position is adjusted. The adjustment of the stop angle with the adjustment button group 65 or the slide bar 66 shown in FIG. 4 may alternatively be used together therewith. Namely, a user operates the operation levers 21 and 22 and adjusts visually the stop position of the arm 11, and evaluates the stop position as the stop angle with the position sensor 11*b* so as to reflect it to the adjusted first stop angle A1 displayed in the item 63 of the new set value.

According to the configuration, for example, at the first stop position SA, the arm 11 is moved actually and evaluated as the first stop angle A1, and at the step S14 shown in FIG. 5, the input means 51 judges whether the first stop angle A1 which is evaluated by moving actually the arm 11 is within the adjustable range or not. Namely, the input means 51 performs the judgement so as to realize a relation of the minimum stop angle X set previously≤the first stop angle A1 which is evaluated by moving actually the arm 11<the stop angle X1 set previously.

Next, the stop positions SA, SB and SC which are set for avoiding interference of the working device 4 in another embodiment are explained.

An explanation of the same configuration is omitted and explained with the same reference characters as the above embodiment.

The set angle of each of the stop positions SA, SB and SC of the above embodiment can be changed within the adjustment range set previously. Contrarily, in another embodiment shown below, the adjustment ranges corresponding to the stop positions SA, SB and SC are changed following change of setting of the stop positions SA, SB and SC.

Namely, the adjustable range of the new first stop angle A1 at the first stop position SA is X≤A1<B. The adjustable range of the new second stop angle B1 at the second stop position SB is A<B1<C. The adjustable range of the new third stop angle C1 at the third stop position SC is B<C1≤Y. When one of the stop angles A, B and C is adjusted and updated to corresponding one of the new stop angles A1, B1 and C1, the one of the new stop angles A1, B1 and C1 is used as the standard of the adjustable range at the time of adjusting the other stop angles A, B and C. For example, when the first stop angle A is adjusted and updated to the new first stop angle A1 and subsequently the second stop angle B is adjusted, the adjustable range of the new second stop angle B1 is A1<B1<C.

Figure 12:
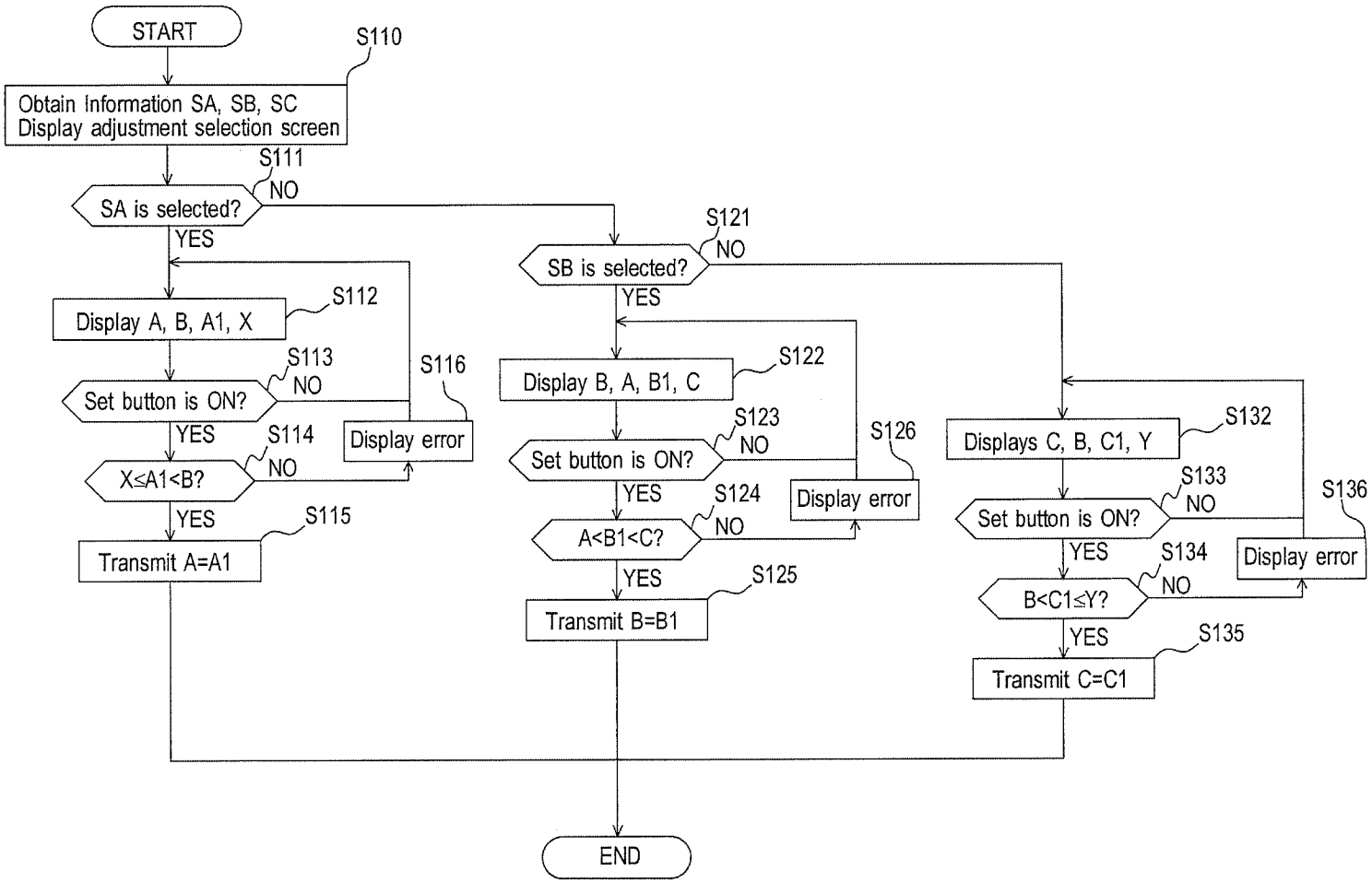
FIG. 12 is a flow chart of adjustment of the stop positions in the input means according to another embodiment.

Next, control steps of the input means 51 adjusting the stop angles A, B and C of the stop positions SA, SB and SC are explained referring to FIGS. 3, 4 and 12.

Firstly, as shown in FIG. 3, the input means 51 is connected to the control device 28 at the side of the backhoe 1 and started so as to enable the adjustment of the stop angles A, B and C corresponding to the stop positions SA, SB and SC.

Namely, at a step S110 of a flow chart of the adjustment of the stop positions SA, SB and SC in the input means 51 shown in FIG. 12, the input means 51 obtains information of the stop positions SA, SB and SC which has been set actually from the control device 28 of the backhoe 1, and displays the adjustment selection screen 53 (see FIG. 4). When an operator selects one of the three items 54, 55 and 56 of the stop positions displayed in the adjustment selection screen 53, the control is shifted from the step S110 to a step S111.

At the step S111, the input means 51 judges whether the first stop position SA (item 56) is selected or not.

As a result, when the first stop position SA is judged to be selected, the input means 51 shifts from the step S111 to a step S112.

On the other hand, when the first stop position SA is judged not to be selected, that is, when the second stop position SB or the third stop position SC is judged to be selected, the input means 51 shifts from the step S111 to a step S121.

At the step S112, the input means 51 displays the adjustment screen 57 shown in FIG. 4B. At this time, the input means 51 displays the adjustable maximum value B and the adjustable minimum value X of the first stop position SA, the first stop angle A which is the actual set value, and the set value A1 to be adjusted in the adjustment screen 57. Then, by operating the adjustment button group 65 or the slide bar 66, a user adjusts the first stop angle A to the new first stop angle A1.

At a step S113, the input means 51 judges whether the user pushes the set button 67 after adjusting the new first stop angle A1 of the first stop position SA or not.

As a result, when the set button 67 is judged to be pushed, the input means 51 shifts from the step S113 to a step S114.

On the other hand, when the set button 67 is judged not to be pushed, the input means 51 shifts from the step S113 to the step S112 again.

At the step S114, the input means 51 judges whether the adjusted first stop angle A1 is within the adjustable range or not. Namely, the input means 51 judges whether "the stop angle X at which the arm 11 is the most close to the revolving device 3≤the adjusted first stop angle A1<the second stop angle B" or not.

As a result, when the adjusted first stop angle A1 is judged to be within the adjustable range, the input means 51 shifts from the step S114 to a step S115.

On the other hand, when the adjusted first stop angle A1 is judged to be out of the adjustable range, the input means 51 shifts from the step S114 to a step S116. At the step S116, it is displayed that the adjusted first stop angle A1 cannot be adjusted (changed) (the error is displayed), and then the input means 51 shifts from the step S116 to the step S112.

At the step S115, the input means 51 transmits the adjusted first stop angle A1 as the new first stop angle A to a storage part 29 of the control device 28 and finishes the control.

The transferred new first stop angle A1 is updated in the storage part 29 of the control device 28 by finishing and restarting the backhoe 1.

Similarly, when the input means 51 judges that the second stop position SB is selected, at the step S124, the input means 51 judges whether the adjusted second stop angle B1 is within the adjustable range or not. Namely, the input means 51 judges whether "the first stop angle A at the first stop position SA<the adjusted second stop angle B1<the third stop angle C at the third stop position SC" or not. At this time, the adjusted second stop angle B1 is not less than the first stop angle A and not more than the third stop angle C so that the relation among the values of the stop positions SA, SB and SC is not reversed, whereby confusion caused by reversing the magnitude at the time of selecting the plurality of the values of the stop positions is prevented.

As a result, when the adjusted second stop angle B1 is judged to be within the adjustable range, the input means 51 shifts from the step S124 to a step S125.

On the other hand, when the adjusted second stop angle B1 is judged to be out of the adjustable range, the input means 51 shifts from the step S124 to a step S126. At the step S126, it is displayed that the adjusted second stop angle B1 cannot be adjusted (changed) (the error is displayed), and then the input means 51 shifts from the step S126 to the step S122 again.

Similarly, when the input means 51 judges that the third stop position SC is selected, at the step S134, the input means 51 judges whether the adjusted third stop angle C1 is within the adjustable range or not. Namely, the input means 51 judges whether "the second stop angle B at the second stop position SB<the adjusted third stop angle C1≤the stop angle Y at which the arm 11 is the most separated from the boom 10" or not. At this time, the adjusted third stop angle C1 is not less than the second stop angle B so that the relation between the values of the stop positions SB and SC is not reversed, whereby confusion caused by reversing the magnitude at the time of selecting the plurality of the values of the stop positions is prevented.

As a result, when the adjusted third stop angle C1 is judged to be within the adjustable range, the input means 51 shifts from the step S134 to a step S135.

On the other hand, when the adjusted third stop angle C1 is judged to be out of the adjustable range, the input means 51 shifts from the step S134 to a step S136. At the step S136, it is displayed that the adjusted third stop angle C1 cannot be adjusted (changed) (the error is displayed), and then the input means 51 shifts from the step S136 to the step S132 again.

As the above, the working vehicle (backhoe 1) has the revolving device 3 which is the working machine body, the working device 4 which is connected to the working machine body and has the boom fulcrum 10*a*, the arm fulcrum 11*a* and the attachment fulcrum 12*a* which are the plurality of the joints, and whose tip is connected detachably to an attachment, and the control device 28 in which the stop positions SA, SB and SC are set so as to stop the working device 4 for avoiding interference of the working device 4. The control device 28 is connected to the position sensor 11*b* which is the detection means detecting the position of the working device 4, the input means 51 which sets previously the plurality of the stop positions SA, SB and SC and adjusts independently the plurality of the stop positions SA, SB and SC, and the screen operation part 27 which is the selection means selecting the plurality of the stop positions SA, SB and SC.

According to the configuration, the plurality of the stop positions SA, SB and SC can be adjusted independently, and the adjusted stop position does not affect the other stop positions. Accordingly, when the attachment 12 is exchanged, readjustment is not required and the interference with the attachment 12 can be avoided, whereby reduction of working efficiency can be relieved.

Concerning each of the plurality of the stop positions SA, SB and SC, the adjustment range which does not include the other stop positions SA, SB and SC is determined.

According to the configuration, the value of the adjustment range of each of the stop positions SA, SB and SC does not includes the stop positions except for the stop position to be adjusted so that the relation among the values of the stop positions SA, SB and SC in the screen operation part 27 which is the selection means is not reversed, whereby confusion at the time of selecting the plurality of the values A, B and C of the plurality of the stop positions SA, SB and SC is prevented.

The input means 51 adjusts the stop positions SA, SB and SC by inputting numerical values.

According to the configuration, the stop positions SA, SB and SC can be adjusted without moving the working device 4, whereby the adjustment work can be performed easily.

The input means 51 adjusts the stop positions SA, SB and SC by direct teaching which makes the working device 4 move to the stop positions SA, SB and SC and memorizes the positions.

According to the configuration, at the time of adjusting the stop positions SA, SB and SC, the stop positions SA, SB and SC can be checked visually, whereby the adjustment work can be performed easily. Furthermore, when the adjustment of the stop positions SA, SB and SC with the direct teaching gets out of the adjustment range, the stop positions are not adjusted so that the relation between the values of the stop positions SA, SB and SC (the stop angles A, B and C) in the screen operation part 27 which is the selection means is not reversed, whereby confusion at the time of selecting the plurality of the values A, B and C of the plurality of the stop positions SA, SB and SC is prevented.

At least a part of the input means 51 is detachably attached to the control device 28.

According to the configuration, the stop positions SA, SB and SC cannot be adjusted carelessly, whereby the working device 4 can be operated safely.

The position sensor 11*b* which is the detection means detects the angle of the arm fulcrum 11*a* which is the joint of the working device 4.

According to the configuration, by only detecting the angle of the working device 4 (the stop angles A, B and C), the stop positions SA, SB and SC can be judged, whereby the control configuration can be made simple.

INDUSTRIAL APPLICABILITY

The present invention can be used for an art of restricting a movable range of a working device of a working vehicle.

The invention claimed is:

1. A working vehicle comprising:

a working machine body;

a working device which is connected to the working machine body and has a plurality of joints and whose tip is connected detachably to an attachment; and a control device in which a stop position is set so as to stop the working device for avoiding interference of the working device, characterized in that the control device is connected to a detection means which detects a position of the working device, an input means which sets previously a plurality of stop positions and adjusts independently the plurality of stop positions, and a selection means which selects the plurality of stop positions, concerning each of the plurality of stop positions, an adjustment range which does not include the other stop positions is determined, and when one of the plurality of stop positions is adjusted, the adjustment range of another of the plurality of stop positions is changed based on one of the plurality of stop positions which is adjusted.

2. The working vehicle according to claim 1, input means adjusts the stop positions by direct teaching which makes the working device move to the stop positions and memorizes the positions.

3. The working vehicle according to claim 1, wherein at least a part of the input is detachably attached to the control device.

4. The working vehicle according to claim 2, wherein at least a part of the input means is detachably attached to the control device.

5. The working vehicle according to claim 1, wherein the detection means detects an angle of at least one of the plurality of joints of the working device.

6. The working vehicle according to claim 2, wherein the detection means detects an angle of at least one of the plurality of joints of the working device.

7. The working vehicle according to claim 3 wherein the detection means detects an angle of at least one of the plurality of joints of the working device.

8. The working vehicle according to claim 4 wherein the detection means detects an angle of at least one of the plurality of joints of the working device.

* * * * *